US007794078B2

(12) United States Patent
Coenen et al.

(10) Patent No.: US 7,794,078 B2
(45) Date of Patent: Sep. 14, 2010

(54) METHOD OF PRINTING A SUBSTRATE WITH AN INKJET PRINTER, AND AN INKJET PRINTER SUITABLE FOR PERFORMING THIS METHOD

(75) Inventors: Jeroen J. G. Coenen, Venray (NL); Barry B. Goeree, Venlo (NL)

(73) Assignee: Oce-Technologies B.V., Venlo (NL)

( * ) Notice: Subject to any disclaimer, the term of this patent is extended or adjusted under 35 U.S.C. 154(b) by 364 days.

(21) Appl. No.: 11/220,640

(22) Filed: Sep. 8, 2005

(65) Prior Publication Data

US 2006/0050129 A1 Mar. 9, 2006

(30) Foreign Application Priority Data

Sep. 9, 2004 (NL) ..... 1027002

(51) Int. Cl.
*B41J 2/01* (2006.01)

(52) U.S. Cl. ..... 347/104; 346/136; 347/8; 347/220; 399/167; 399/384; 399/401; 400/59; 400/605; 400/617; 400/625

(58) Field of Classification Search ..... 347/101, 347/104

See application file for complete search history.

(56) References Cited

U.S. PATENT DOCUMENTS 4,165,029 A * 8/1979 Mitchell ..... 226/25
5,351,071 A * 9/1994 Matsuda et al. ..... 346/136
5,820,282 A * 10/1998 Nakai ..... 400/642

(Continued)

FOREIGN PATENT DOCUMENTS

EP 0 666 180 A2 8/1995

(Continued)

*Primary Examiner*—Matthew Luu
*Assistant Examiner*—John P Zimmermann
(74) *Attorney, Agent, or Firm*—Birch, Stewart, Kolasch & Birch, LLP

(57) ABSTRACT

The invention relates to a method of printing a substrate using an inkjet printer which includes a holder to rotatably receive a roll on which the substrate is wound, a downstream print zone and an inkjet printhead for printing the substrate at the print zone, a transport means for engaging and transporting the substrate to the print zone during which transport the substrate is unwound from the roll, and a guide element which is situated downstream of the roll in front of the transport means to guide the substrate from the roll to the transport means, the method including the steps of transporting the substrate over a predetermined distance with control of the transport means, during which transport the guide element is moved from a first position which the guide element occupies prior to the transport, to a second position such that the distance over which the substrate extends between the roll and the transport means is smaller as a result of the movement and after the substrate has been transported over the predetermined distance, printing a strip of the substrate with control of the inkjet printhead, and after printing of the strip, the re-transport of the substrate over a predetermined distance during which the guide element is moved, which transport is followed by printing a following strip of the substrate, wherein the guide element is brought into the first position prior to the re-transport of the substrate.

6 Claims, 4 Drawing Sheets

U.S. PATENT DOCUMENTS

| | | | | |
|---|---|---|---|---|
| 5,850,233 | A * | 12/1998 | Otsuka et al. | 346/136 |
| 6,068,374 | A * | 5/2000 | Kurata et al. | 347/108 |
| 6,633,740 | B2 * | 10/2003 | Estabrooks | 399/384 |
| 2002/0085078 | A1 * | 7/2002 | Tanno | 347/104 |
| 2005/0002718 | A1 * | 1/2005 | Winter et al. | 400/579 |
| 2005/0024464 | A1 * | 2/2005 | Takagi | 347/104 |

FOREIGN PATENT DOCUMENTS

| | | |
|---|---|---|
| EP | 1 219 454 A2 | 7/2002 |

* cited by examiner

METHOD OF PRINTING A SUBSTRATE WITH AN INKJET PRINTER, AND AN INKJET PRINTER SUITABLE FOR PERFORMING THIS METHOD

BACKGROUND OF THE INVENTION

The present invention relates to a method of printing a substrate using an inkjet printer, which printer includes a holder which rotatably receives a roll on which the substrate is wound, a downstream print zone and an inkjet printhead for printing the substrate in the print zone, a transport means for engaging and transporting the substrate to the print zone as the substrate is unwound from the roll, and a guide element which is situated downstream of the roll in front of the transport means to guide the substrate from the roll to the transport means. The printing method includes the steps of transporting the substrate over a predetermined distance with control of the transport means, during which transport the guide element is moved from a first position occupied by said guide element prior to the transport, to a second position such that the distance over which the substrate extends between the roll and the transport means is smaller as a result of the movement and after the substrate has been transported over the predetermined distance; printing a strip of the substrate with control of the inkjet printhead, and, after printing of the strip, the re-transport of the substrate over the predetermined distance during which the guide element is moved, which transport is followed by printing a following strip of the substrate.

The present method is used inter alia to prevent damage to the substrate during its transport. The transport means, which is frequently a transport nip which engages the substrate at a number of places distributed over the width of the substrate, has a lower mass inertia than the roll on which the substrate is wound, at least when there is a specific minimum amount of substrate present on the roll. The transport of the substrate and its simultaneous unwinding from the roll can, in this case take place at an adequate speed if the transport means is, for example, driven by a very powerful motor, both the transport means and the roll being accelerated. The result of using such a powerful motor is that considerable forces are exerted on the substrate, with the risk that the substrate will tear. In addition, a powerful motor of this kind has the disadvantage that it is less suitable for very accurate control. In inkjet printers in particular, accurate control of the transport means is very important, because printing often takes place by printing the substrate in a number of swaths, and in each swath, part of the substrate is printed, often a strip of the same width as the inkjet printhead. All the sub-images together form the image for printing. For accurate juxtaposition of the sub-images, accurate transport of the substrate is desirable.

It has been determined to provide the transport means with a low-power driving motor and to dispose a movable guide element between the roll and the transport means. By moving this element, it is possible to reduce the distance over which the substrate extends between the roll and the transport means. This prevents any sudden increase in substrate tension. The motor that drives the transport means consequently does not have to move the entire roll each time. It is thus possible to use a relatively low power drive for the transport means, it being a relatively simple matter to make such drive accurate. In this method, the roll can be driven separately with a powerful but less accurate motor.

A disadvantage of this method is that for the accurate transport of the substrate by the transport means there is required not only an accurate drive but also a very accurate transport means and guide element. The mechanical tolerances such as roundness, straightness, mutual parallelism, etc., are subject to stringent requirements in order that the transport may take place with the required accuracy. In addition, even with very close tolerances, there are still a relatively large number of irregularly recurring juxtaposition faults between the sub-images. These juxtaposition faults are indications of random faults in the substrate transport.

SUMMARY OF THE INVENTION

The object of the present invention is to obviate the above disadvantages. To this end, a method has been developed wherein the guide element is brought into a first position prior to the re-transport of the substrate. Thus, whenever the substrate is incrementally moved for the printing of a following strip, the guide element is first brought into the same initial position. This is possible if the substrate, during each transport increment, is transported by the transport means the same distance as the substrate is unwound from the roll. Since the mass inertia of the roll differs from that of the transport means, the transport of the substrate by the transport means and the unwinding of the substrate from the roll are out of phase, but this difference can be compensated for by the movement of the guide element.

It has been found that the application of this method results in far fewer irregularly, recurring, juxtaposition faults between the sub-images. Regularly recurring juxtaposition faults still occur, but this problem can be obviated easily by calibration. As is sufficiently known from the prior art, regularly recurring faults can easily be taken into account, for example during control of the inkjet printhead or heads, so that these faults can be completely eliminated.

Since the guide element is, in each case, brought to the initial position, the method of transport including all faults which occur due to out of true, crookedness, non-parallelism, friction, slip, compliance, etc, is practically the same each time and there is therefore a pattern of regular deviations in the transport. Since they are known in advance, it is possible to easily compensate for these regularly recurring faults. Thus it is possible to use transport means and guide elements with less accurate mechanical tolerances.

In one embodiment, in order to transport the substrate to the print zone, a part of the substrate is first unwound from the roll prior to control of the transport means for the purpose of such transport. In this embodiment, therefore, the method starts first with unwinding part of the substrate from the roll. This gives a kind of loop of "free" substrate. This loop can be restricted to a minimum, for example, by moving the guide element. The transport medium itself is not actuated until some later time. Directly prior to this, care is taken to ensure that the guide element is in its fixed initial position. Since the roll has already been incrementally unwound, there will be no shortage of "free" substrate even in the event of considerable acceleration of the transport means. As soon as there is a risk of excessive tension in the substrate as a result of the further transport thereof, this tension can be reduced by moving the guide element in the direction of a second position. After the transport of the substrate is complete, the guide element is returned to the first position, and if necessary a corresponding amount of substrate is unwound from the roll for the purpose by driving the drive motor for the roll.

In another embodiment, the maximum speed at which the substrate is unwound from the roll during transport of the substrate is less than the maximum speed of transport imparted by the transport means. This embodiment has the advantage that the roll, which may have a relatively high mass inertia, does not acquire a very high speed of revolution. This could, in fact, cause problems during the stoppage of the roll. Rapid braking of an inert roll may cause shocks and hence have a negative effect on the accuracy of the substrate transport. In addition, the requirements to be met by the drive motor for the roll are reduced because as a result of the lower maximum speed it is possible to apply reduced accelerations.

The present invention also relates to an inkjet printer for printing a substrate, provided with a holder to rotatably receive a roll on which the substrate is wound, a downstream print zone and an inkjet printhead for printing the substrate in the print zone, a transport means for engaging and transporting the substrate to the print zone, and a guide element which is situated downstream of the roll in front of the transport means to guide the substrate from the roll to the transport means. The guide element is movably disposed in the printer in such a manner that it can be moved between a first position in which the distance over which the substrate extends between the roll and the transport means has a first value, and a second position in which the distance has a second value less than the first, wherein the printer is provided with a control unit which ensures that the guide element occupies the first position directly prior to the transport of the substrate over a predetermined distance, having as its objective to make a strip of the substrate available for printing.

In a further embodiment, the printer is provided with a spring element which provides resistance to the displacement of the guide element. By the use of the spring element, it is possible to obtain a relatively low resistance to movement of the guide element. This can further minimize any build-up of tension in the substrate.

In yet another embodiment, the spring is disposed substantially parallel to the guide element. It has been found that in this way it is very easy to provide adequate resistance to movement of the guide element, the resistance being sufficiently low so as not to have an adverse effect on the substrate transport. The spring element may include a number of weak springs coupled in series.

In still another embodiment, upstream of the guide element the printer contains a second transport means for transporting the substrate. The advantage of this embodiment is that there is a further decoupling of forces between the drive for the first transport means and the drive for the roll. Thus the substrate can be maintained taut between the first and second transport means despite the fact that a section of substrate has already been unwound from the roll prior to transport by the first transport means. This provides more possibilities of accurate transport of the substrate.

In yet a further embodiment, the guide element is a roller which comprises a shaft on which a number of substantially congruent (identical in shape) wheels are disposed. The roller can be provided with a curved guide plate to guide the substrate to the roller. This has been found advantageous during the introduction of the web over the transport means, and can have a positive effect on further preventing unwanted mechanical wear of the substrate during its transport.

BRIEF DESCRIPTION OF THE DRAWINGS

The present invention will now be explained in detail with reference to the following drawings, wherein.

DETAILED DESCRIPTION OF THE INVENTION

Figure 1:
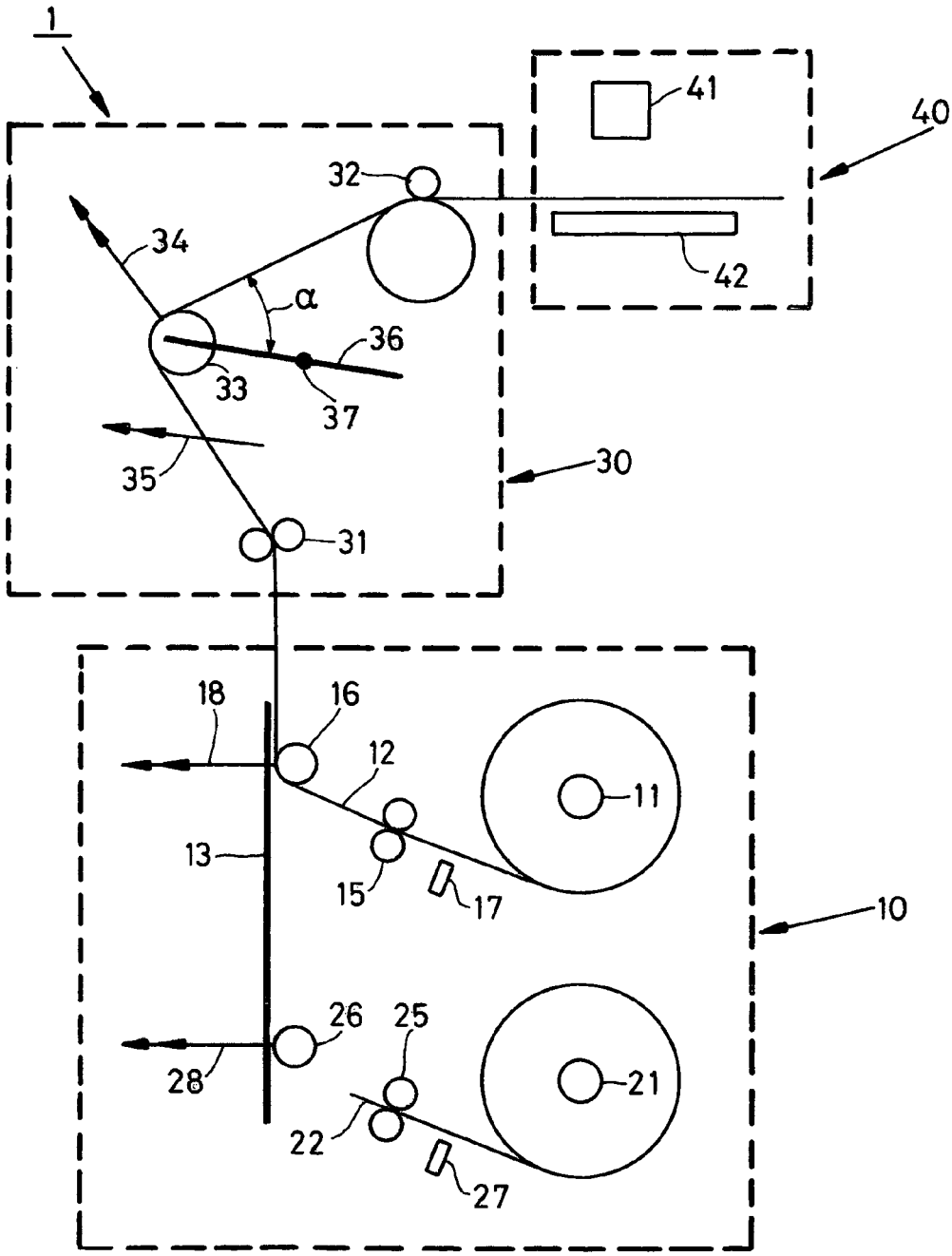
FIG. 1 is a diagram of a printer according to a specific embodiment of the present invention.

FIG. 1 is a diagram of a printer according to the present invention. This printer is provided with the supply unit 10, which serves for the storage and delivery of the substrate for printing. In addition, this printer includes a transport unit 30 which transports the substrate from the supply unit 10 to the print engine 40. Unit 30 also provides accurate positioning of the substrate in the print zone formed between the print surface 42 and the inkjet printhead 41. In this embodiment, print engine 40 is a conventional engine which includes printhead 41, which is constructed from a number of separate subheads, each of one of the colors: black, cyan, magenta and yellow. Printhead 41 has only a limited printing range so that it is necessary to print the image on the substrate in different sub-images. To this end, the substrate is transported in increments in each case so that a new part of the substrate can be printed in the print zone. In the example illustrated, the substrate 12 comes from a roll 11 from the supply unit 10. A web of the substrate is wound on this roll, the web having a length of 200 meters. To accommodate the roll in the printer, the supply unit is provided with a holder (not shown) to rotatably receive the roll. This holder consists of two parts mounted in side plates of the printer, which parts are brought into cooperative connection with the ends of the roll. In this embodiment, the supply unit is provided with a second holder to receive roll 21. Another substrate 22 is wound on this roll and can also be delivered by the supply unit for printing. For the transport of the substrate, roll 11 is operatively connected to transport means 15, which in this case includes a pair of rolls between which a transport nip is formed. More particularly, means 15 is a set of two shafts each extending in a direction substantially parallel to roll 11, on which a number of roll pairs are mounted, each forming a transport nip for the substrate. In an alternative embodiment, only one roll pair is mounted on the shafts, substantially coinciding with the middle of the web 12.

Upstream of means 15 is a sensor 17, by means of which it is possible to determine whether there is still substrate on the roll situated in the associated holder. As soon as the roll is used up, the end of the web will pass the sensor, and this is detected by the sensor. For the transport of a substrate originating from roll 21, the supply holder is provided with transport means 25. Upstream of the transport means the supply holder is provided with sensor 27, which has the same action as sensor 17. The supply holder is provided with guide elements 16 and 26 to guide the substrates 12 and 22, respectively, to the transport unit 30. Downstream of these guide elements, there is a transit path 13. This transit path is used for both the transport of substrate 12 and the transport of substrate 22.

A substrate leaving the supply unit 10, in this example substrate 12, is engaged by transport means 31 of the transport unit 30. This transport means transports the substrate via guide element 33 on to the second transport means 32 of the transport unit 30. The transport means 32 engages the substrate, transports it to print engine 40 and ensures good positioning of the substrate in the print zone between the print surface 42 and the printhead 41. The transport means 31 and 32 extend substantially parallel to the rolls 11 and 21, and have a length such that the substrate can be engaged over substantially its entire width.

The guide elements 16 and 26 are, in this example, rollers extending parallel to the transport means 15 and 31; 25 and 31, respectively. They are substantially stationary rollers, i.e., they do not rotate about their axial axis. For the substrate 12 illustrated, this means that during transport, the substrate slides over element 16 and is at the same time fed in the direction of transport means 31. When this configuration is used it has been found that movement of the substrate at the guide element in a direction parallel to the direction in which the element extends is possible. In other words, the substrate can in this way make a lateral movement with respect to the direction in which the substrate is transported. The reason that a lateral movement of this kind is possible in this configuration is associated with the fact that the substrate makes a sliding movement with respect to the guide element. As a result, the required frictional force to set the substrate in motion initially with respect to the guide element is already overcome and practically no force is needed to move the substrate laterally over the guide element.

The guide elements are so disposed in the supply unit that they can each rotate, at least through a limited angle, about an axis substantially perpendicular to the direction in which the guide elements extend (i.e. the axial direction of the guide elements). In the Figure, the rotational axis 18 of element 16 is shown, and also rotational axis 28 of element 26. These rotational axes are perpendicular to the axes of the guide elements and intersect the centre of said elements. As a result of this rotation combined with the possibility of moving the substrate laterally, the substrate has been found to have very good guidance from the supply unit 10 to nip 31 of the transport unit 30. As a result, despite the fact that the transport means 15 and 31; 25 and 31 respectively are not perfectly parallel, it is nevertheless possible to transport the substrate without any damage thereto.

Guide element 33 of transport unit 30, which element extends substantially parallel to the transport means 31 and 32, is also so disposed that it can rotate about an axis perpendicular to the axial direction of said element. This axis is shown by reference 34 and intersects the center of guide element 33. Since element 33, in this embodiment, is a co-rotating roller, the substrate is substantially stationary with respect to the surface of said guide element. As a result, lateral movement of the substrate at the guide element is made difficult. In order that such a movement can be made possible, element 33 is suspended so that it can rotate about axis 35, which axis 35 extends parallel to the bisector 36 of the angle $2\alpha$ over which the substrate is fed from transport means 31 to transport means 32. This axis 35 intersects the center of the substrate web at a distance of about 1 meter from the guide element itself. On the rotation of element 33 about this axis, the substrate makes a substantially lateral movement. The possibility of rotation of guide element 33 over the axes of 34 and 35 ensures flexible and accurate transport of the substrate from transport means 31 to transport means 32, even though the two means do not extend 100% parallel to one another.

Guide element 33 is movable from a first position in which it is situated in FIG. 1, to a second position in which the center of this element coincides with the location 37. In the first position, the distance over which substrate 12 extends between transport means 31 and transport means 32 is at a maximum. In the second position this distance is at a minimum. Use is made of this fact during the transport of the substrate to print engine 40. Since the substrate must in each case be moved over a relatively short distance, typically 5 to 10 cm, it is advantageous for this to occur relatively quickly. The mass inertia of roll 11, certainly when it is provided with the maximum quantity of substrate, is relatively high. For this reason, if the configuration of transport means and guide elements as illustrated were maintained, movement would take a considerable amount of time. To counteract this problem, transport means 31 is accelerated much more slowly than transport means 32. Nevertheless, in order to ensure adequate supply of substrate to transport means 32, the guide element 33 is moved in the direction of location 37. As a result, there is no lack of substrate at transport means 32 during its passage to print engine 40. If the passage by transport means 32 is stopped, the residue at transport means 31 is compensated for by allowing the transport means to continue rotating for some time. In these conditions, the element 33 is moved back to its first position. In this way, prior to the subsequent transport of a part of the substrate requiring printing with print engine 40, guide element 33 is in the same initial starting position. It has been found that in this way very accurate transport of the substrate is possible. As a result, the various sub-images can match up more satisfactorily and the number of print artifacts can be reduced.

The provision of accurate transport and particularly accurate positioning of the substrate in the print zone by the control of transport means 32, is related to the fact that the substrate is engaged by both transport means 31 and transport means 32. The position of the substrate is more satisfactorily defined as a result. Together with the rotational possibilities of guide element 33, very accurate transport and positioning of the substrate is obtained, with the tension in the substrate not increasing to the extent where, under normal circumstances, mechanical damage of the substrate would occur. An important additional advantage of this arrangement is that printing can still be continued on the substrate as long as the end of the web has not passed transport means 31. The instant at which this happens can easily be determined if the end of the web is detected by means of the sensor 17 or 27 operatively associated with the web. It is then a simple matter to determine what length of the substrate can still be fed on to the print engine 40 before the end of the web passes the means 31. In this way it is possible to determine whether the image printed at that instant can still be completely imaged on the substrate without the end of the web passing the first transport means. If so, that image will be completed. If not, then it is possible to choose to stop printing. However, when the end of the web passes means 31 the transport and the positioning of the substrate may be accompanied by more errors, and this may result in print artifacts. Too many artifacts can result in the image having to be reprinted. In order to save ink and substrate it is therefore better to stop printing.

If it is still possible to print the current image on the substrate (without the end of the web passing the means 31), it is then possible to determine whether the next image for printing can still be printed on the substrate (without the end of the web passing the means 31). If so, that image will be printed. If not, then it is better to print the following image on a new substrate, for example originating from roll 21.

Figure 2A:
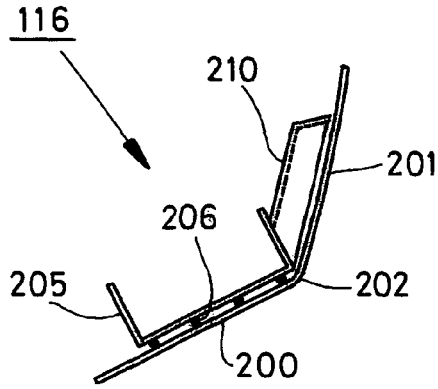
FIGS. 2*a* and 2*b* show a guide element that can be used as a guide for the substrate.
Figure 2B:
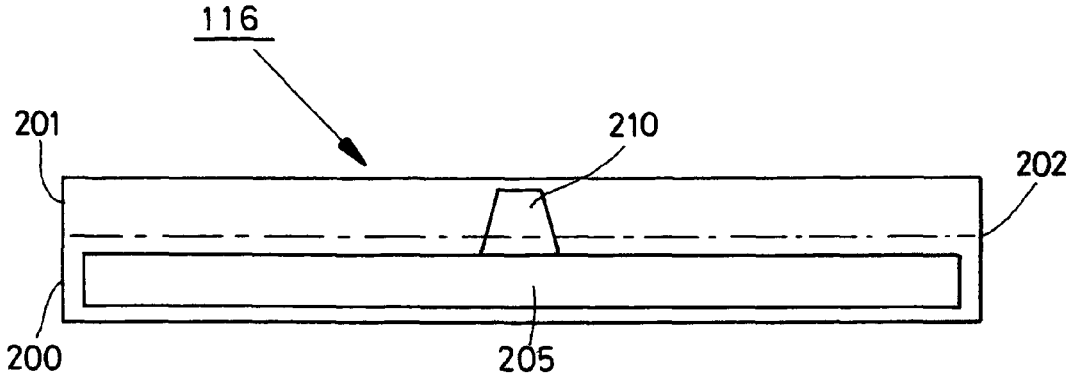

FIGS. 2*a* and 2*b* show a guide element 116 which can be used in a preferred embodiment as a guide for the substrate in the supply unit 10 (instead of the guide element 16 and/or 26). FIG. 2*a* is a side elevation of the guide element. This element comprises a bent plate having a part 200 situated upstream of the bend 202, and a part 201 which is situated downstream of the bend 202. Part 200 is connected by spot welds 206 to rigid frame part 205. The frame part 205 is a U-profile extending over the length of element 116 and connected to the frame of the printer. Part 201 of the plate is much less restricted in its freedom of movement than part 200. Yoke 210 fixed on the U-shaped profile 205 provides a point of support for part 201, as seen in the front elevation of element 116, as shown in FIG.

2*b*. It will be clear from this front elevation that part 201 is substantially free. Since the plate is relatively thin, part 201 is torsionally weak and can at least partially rotate about the axis passing through the center of the yoke 210 and perpendicular to the longitudinal axis of element 116. In one embodiment, part 201 is provided with slots so that this part has less resistance to torsion.

If element 116 is placed in the supply unit to replace element 16, the free end of plate part 200 points towards the transport nip 15 and part 201 is substantially parallel to the transit path 13 of the supply unit. Element 116 is also stationary in the supply unit. As a result of the tension in the substrate, part 201 can be pulled against yoke 210. As a result, the ends particularly of part 201 can rotate about the axis passing through the center of the yoke, perpendicular to the direction in which element 116 extends. The advantages of this rotational possibility are described under FIG. 1.

Figure 3A:
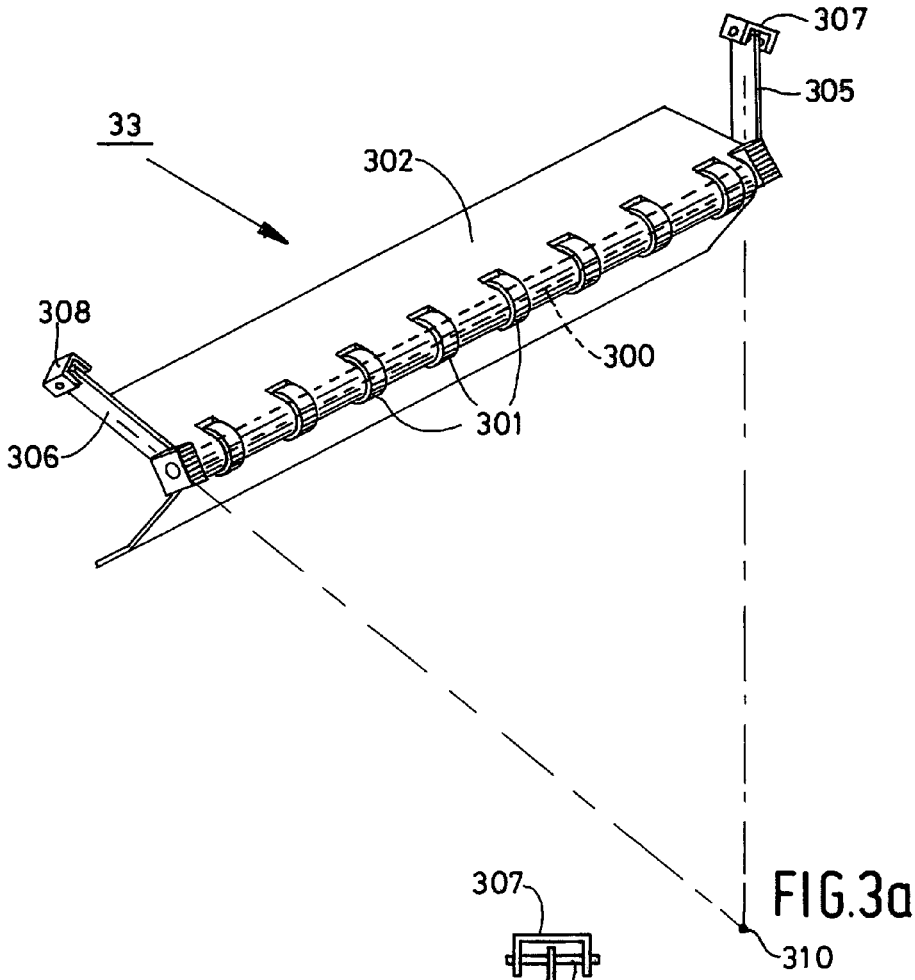
FIGS. 3*a*, 3*b*, and 3*c* show another embodiment of the guide element.

FIG. 3*a* is a diagram of one embodiment of guide element 33. In this embodiment element 33 comprises a shaft 300 on which a series of transport wheels 301 are disposed. The substrate is guided over these wheels. Since the shaft is suspended to be freely rotatable, it can co-rotate with the substrate without any mutual difference in speeds. As a result, the frictional force accompanying the transport of the substrate at the roller is practically only dependent on the friction in the mounting of this roller.

Element 33 is provided with a guide plate 302 bent in the form of a V to assist in guiding the substrate. It should also be clear that the V-shape of the element 302 substantially coincides with the V-shape of the substrate as shown in FIG. 1. Shaft 300 is resiliently suspended by leaf springs 305 and 306 which are fixed to be freely rotatable on fixed frame parts 307 and 308 respectively. These leaf springs each form the same angle with the shaft in such a manner that the center lines of the leaf springs have a point of intersection 310 upstream of the roller. Rotational axis 35 intersects this point of intersection.

Figure 3B:
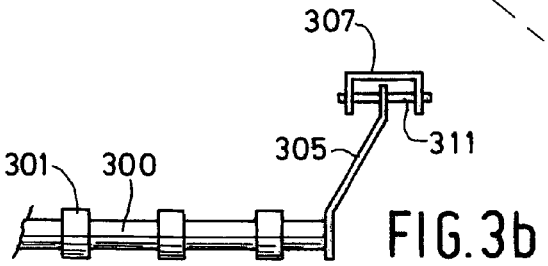

FIG. 3*b* shows the suspension of the shaft in greater detail. The leaf spring 305 is fixed on the end of shaft 300. Leaf spring 305 is, in turn, fixed on shaft 311 which is suspended to be freely rotatable in U-shaped frame part 307. By means of this suspension it is possible for roller 33 to rotate about the axes 34 and 35. Although the rotational possibility is finite, it appears to be sufficient to make possible accurate and reliable transport of the substrate between the nips 31 and 32.

Figure 3C:
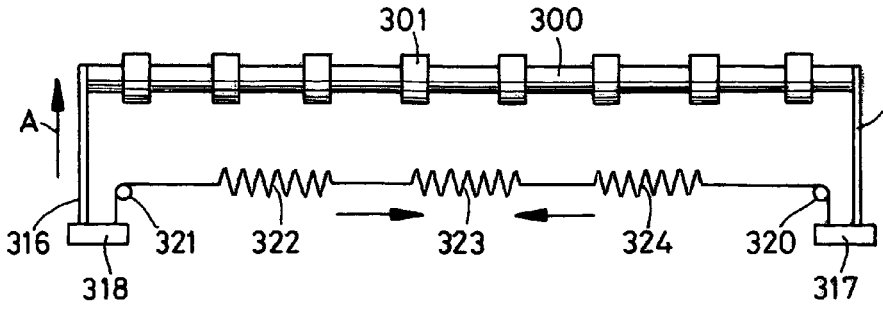

FIG. 3*c* diagrammatically shows the spring mechanism with which roller 33 is pushed in the indicated direction A. This direction A coincides with the direction extending from the above-mentioned second position that the element 33 can occupy (see FIG. 1, location 37) to the first position that the element occupies in FIG. 1. To this end, the shaft 300 is provided with side panels 315 and 316 which at their end remote from the shaft are provided with elements 317 and 318 respectively. The set of weak springs 322, 323 and 324 is fixed to these elements, and freely guided over rotatable wheels 320 and 321. The springs are, to some extent, stretched so that they tend to move the ends of the set of springs to the center thereof, as indicated in FIG. 3*c*. As a result, the elements 317 and 318, and hence the shaft 300, are pushed in the indicated direction A.

Since the construction chosen results in a resistance to the displacement of the roller, a stiffness in respect of the movement of translation is introduced for the roller in principle. During movement of the roller to the second position, the resistance to this movement becomes increasingly greater. The advantage of this resistance is that the movement of the roller takes place more accurately and with more satisfactorily reproducibly. By placing a number of long weak springs in series, this resistance remains sufficiently small but very effective.

Figure 4A:
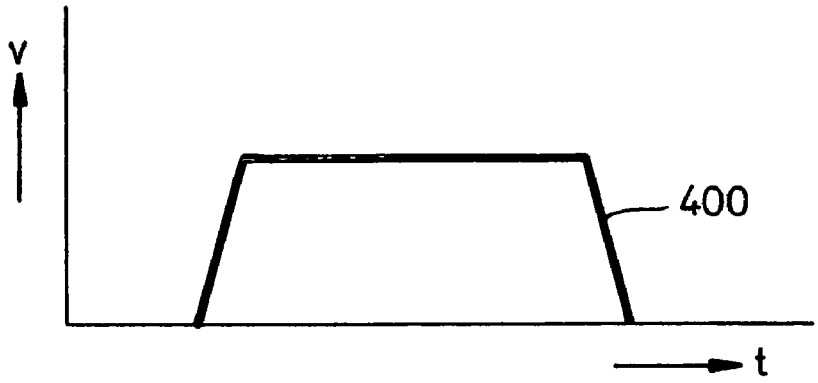
FIGS. 4*a* and 4*b* are diagrams showing the speeds at which the substrate is transported through the transport nips 32 (FIG. 4*a*) and 31 (FIG. 4*b*).
Figure 4B:
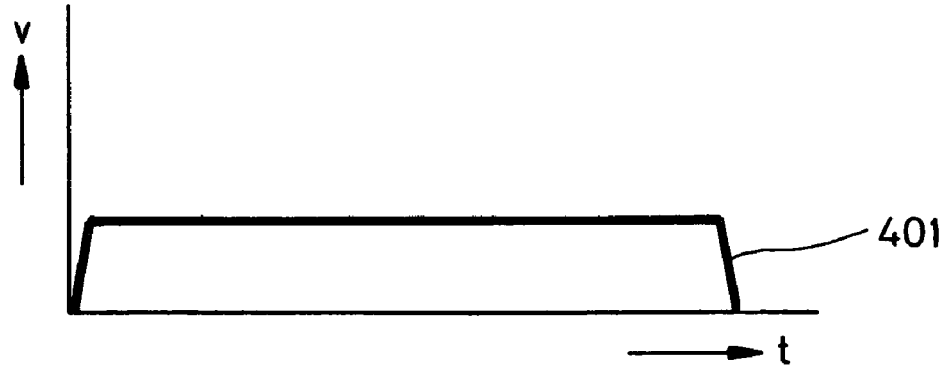

FIGS. 4*a* and 4*b* diagrammatically show the speed at which the substrate is transported through the transport nips 32 (FIG. 4*a*) and 31 (FIG. 4*b*) during the passage of part of the substrate so that a new strip thereof can be printed using the inkjet printhead 41.

Curve 400 in FIG. 4*a* shows what speed of passage is imposed on the substrate at the nip 32. A high speed of transit is generated relatively quickly and this is retained for some time and then rapidly drops to zero. Despite the high mass inertia of the roll on which the substrate is wound, this high acceleration can be obtained by moving roller 33 as indicated under FIG. 1.

Curve 401 in FIG. 4*b* shows the speed of transit imposed on the substrate at nip 31 for the transport of the same length of the substrate. It will be seen that this nip is driven before nip 32 so that the substrate is already partly unwound from roll 11 before nip 32 is driven. It may happen that movement of the roller 33 will enable the web to be tensioned between the means 31 and 32. The acceleration which is imparted by nip 31 is smaller than that of nip 32, and the maximum speed of transit that this nip provides is lower. However, the substrate is passed through for a longer time so that ultimately the same length of the substrate passes the nip 31.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of printing a substrate using an inkjet printer which includes a holder for rotatably receiving a roll on which the substrate is wound, a downstream print zone and an inkjet printhead for printing the substrate in the print zone, a first motor controlled transport means and a second motor controlled transport means, the first motor controlled transport means being for engaging and transporting the substrate to the second motor controlled transport means, the second motor controlled transport means being for engaging and transporting the substrate to the print zone, and a guide element disposed between the first and second motor controlled transport means, the guide element having rotational possibilities perpendicular to its axial direction to guide the substrate, said method comprising the steps of successively:

performing a first transport of the substrate in the direction of the print zone over a predetermined distance while controlling the first and second motor controlled transport means in such a way that the guide element is moved from a first position which said element occupies prior to the transport, to a second position such that the distance over which the substrate extends between the first and second motor controlled transport means is smaller as a result of said transport;

printing a strip of the substrate in the print zone by controlling the inkjet printhead; and performing a second transport of the substrate in the direction of the print zone over a predetermined distance while controlling the first and second motor controlled transport means in such a way that the guide element is moved from the second position to the first position;

wherein an amount of the substrate is unwound from the roll that is sufficient to perform these steps without further unwinding of the roll.

2. The method of claim 1, wherein the steps of printing a strip and performing a second transport are reversed.

3. The method of claim 1, wherein prior to the first transport of the substrate, a part of the substrate is unwound from the roll.

4. An inkjet printer for printing a substrate, provided with a holder which contains a roll rotatably mounted thereon and on which the substrate is wound, a downstream print zone and an inkjet printhead for printing the substrate in the print zone, a first motor controlled transport means and a second motor controlled transport means, the first motor controlled transport means being for engaging and transporting the substrate to the second motor controlled transport means, the second motor controlled transport means being for engaging and transporting the substrate to the print zone, and a guide element in between the first and second motor controlled transport means, wherein the guide element is movably disposed in such a manner that it can be moved between a first position in which the distance over which the substrate extends between the first and second motor controlled transport means has a first value, and a second position in which said distance has a second value which is less than the first value, said printer being provided with a control unit which ensures that the guide element occupies the first position directly prior to the transport of the substrate over a predetermined distance, having as its objective to make a strip of the substrate available for printing, wherein the guide element is a roller which has a freely rotatable shaft on which a number of congruent wheels are disposed, the shaft having rotational possibilities perpendicular to its axial direction, and wherein the roller is provided with a curved guide plate to guide the substrate to and from the roller, wherein the guide element is brought into the first position and the second position without further unwinding of the roll.

5. The inkjet printer according to claim 4, wherein said printer is provided with a spring element which provides resistance to the movement of the guide element.

6. The inkjet printer according to claim 5, wherein the spring is disposed substantially parallel to the guide element.

* * * * *